US009782616B2

(12) United States Patent
Ohtani et al.

(10) Patent No.: US 9,782,616 B2
(45) Date of Patent: Oct. 10, 2017

(54) FIRE EXTINGUISHING AGENT AND FIRE EXTINGUISHING METHOD

(71) Applicants: NATIONAL UNIVERSITY CORPORATION YOKOHAMA NATIONAL UNIVERSITY, Yokohama-shi, Kanagawa (JP); YAMATO PROTEC CORPORATION, Osaka-shi, Osaka (JP)

(72) Inventors: Hideo Ohtani, Yokohama (JP); Yusuke Koshiba, Yokohama (JP)

(73) Assignees: NATIONAL UNIVERSITY CORPORATION YOKOHAMA NATIONAL UNIVERSITY, Yokohama-Shi (JP); YAMATO PROTEC CORPORAITON, Osaka-Shi (JP)

( * ) Notice: Subject to any disclaimer, the term of this patent is extended or adjusted under 35 U.S.C. 154(b) by 119 days.

(21) Appl. No.: 14/898,644

(22) PCT Filed: Jun. 18, 2014

(86) PCT No.: PCT/JP2014/066168

§ 371 (c)(1),
(2) Date: Dec. 15, 2015

(87) PCT Pub. No.: WO2014/203935

PCT Pub. Date: Dec. 24, 2014

(65) Prior Publication Data

US 2016/0114203 A1 Apr. 28, 2016

(30) Foreign Application Priority Data

Jun. 18, 2013 (JP) ..... 2013-127569

(51) Int. Cl.
*A62D 1/00* (2006.01)

(52) U.S. Cl.
CPC ..... *A62D 1/005* (2013.01); *A62D 1/0014* (2013.01); *A62D 1/0042* (2013.01)

(58) Field of Classification Search
None
See application file for complete search history.

(56) References Cited

U.S. PATENT DOCUMENTS 4,594,167 A 6/1986 Kobayashi et al.
6,217,788 B1 4/2001 Wucherer et al.
(Continued)

FOREIGN PATENT DOCUMENTS

CA 2 845 424 A1 2/2013
CN 102179026 A 9/2011
(Continued)

OTHER PUBLICATIONS

Chinese Office Action and Chinese Search Report, issued Oct. 28, 2016, for Chinese Application No. 2014/0034663.3, along with a partial English translation of the Chinese Search Report.
Korean Office Action, dated Feb. 3, 2017, for Korean Application No. 10-2016-7001040, with an English translation.
International Search Report issued in PCT/JP2014/066168, dated Oct. 7, 2014.
Koshiba et al., "Flame suppression ability of metallocenes (nickelocene, cobaltcene, ferrocene, manganocene, and chromocene)", Fire Safety Journal, vol. 51, 2012, pp. 10-17.
Linteris et al., "Flame Inhibition by Ferrocene and Blends of Inert and Catalytic Agents", Proceedings of the Combustion Institute, vol. 28, 2000, pp. 2965-2972.

*Primary Examiner* — Joseph D Anthony
(74) *Attorney, Agent, or Firm* — Birch, Stewart, Kolasch & Birch, LLP

(57) ABSTRACT

A fire extinguishing agent comprising a metallocene and a dispersion medium, the metallocene being dispersed in the dispersion medium.

5 Claims, 5 Drawing Sheets

(56) References Cited

U.S. PATENT DOCUMENTS

| | | | | |
|---|---|---|---|---|
| 8,465,833 | B2 * | 6/2013 | Lee | A62D 1/06 252/2 |
| 8,778,213 | B2 * | 7/2014 | Guo | A62D 1/06 169/44 |
| 2001/0048094 | A1 | 12/2001 | Hagen et al. | |
| 2004/0010066 | A1 * | 1/2004 | Devine | C08J 3/215 524/409 |
| 2004/0226726 | A1 | 11/2004 | Holland et al. | |
| 2013/0052452 | A1 * | 2/2013 | Lee | A62D 1/06 428/323 |
| 2013/0168593 | A1 | 7/2013 | Guo et al. | |
| 2013/0181158 | A1 | 7/2013 | Guo et al. | |
| 2013/0221264 | A1 * | 8/2013 | Guo | A62D 1/06 252/6 |
| 2014/0183399 | A1 * | 7/2014 | Yao | A62D 1/0007 252/2 |

FOREIGN PATENT DOCUMENTS

| | | | |
|---|---|---|---|
| JP | 2006-523514 | A | 10/2006 |
| WO | WO 2012/034490 | A1 | 3/2012 |
| WO | WO 2012/034492 | A1 | 3/2012 |
| WO | WO 2013/023575 | A1 | 2/2013 |

* cited by examiner

FIRE EXTINGUISHING AGENT AND FIRE EXTINGUISHING METHOD

TECHNICAL FIELD

The present invention relates to a fire extinguishing agent and a method for extinguishing fire.

BACKGROUND ART

Methods for extinguishing fire are generally classified into four types, namely, suppression, cooling, suffocation and removal, and fire extinguishing agents have been developed in accordance with the respective characteristics of the methods. Of these methods, the fire extinguishing by suppression is intended to terminate the chain reaction of combustion by capturing radicals generated in the combustion system, and has the advantage that the required amount of fire extinguishing agent is small as compared to the other methods. As the fire extinguishing agents for the fire extinguishing by suppression, those containing an ammonium salt of phosphoric acid, a halon or the like have been developed.

On the other hand, an epoch-making substance having a combustion suppression effect is reported, which is clearly different from the conventional ones. That substance is metallocene. Ferrocene, which is a type of metallocenes, is useful for the synthesis of various organic compounds; therefore, studies have been made so far as to the use of ferrocene mainly in the field of organic chemistry. Meanwhile, in recent years, it has been reported that ferrocene vapor (sublimate) has a combustion suppression effect (see Non-Patent Document 1). Moreover, it is reported that a filter paper to which a metallocene is attached using a solution of ferrocene or other metallocene in an organic solvent can suppress the combustion and exhibits an excellent combustion suppression effect with much less amount of metallocene than the conventional fire extinguishing agent (see Non-Patent Document 2).

Patent Document 1 discloses a fire extinguishing composition containing ferrocene or a derivative thereof in a content of 25% by weight or more. Further, Patent Document 2 discloses microcapsules containing a fire extinguishing composition comprising an iron-containing compound such as ferrocene and an inert gas source.

Thus, there is a growing expectation about the application of a metallocene to the fire extinguishing agent.

PRIOR ART DOCUMENTS

Patent Documents

Patent Document 1: International Patent Application Publication No. 2012/034492

Patent Document 2: US Patent Application Publication No. 2013/0052452

Non-Patent Document

Non-Patent Document 1: Linteris, G. T. et al., Proc. Combust. Inst. 28 (2000) 2965-2972.

Non-Patent Document 2: Koshiba, Y. et al., Fire Saf. J. 51 (2012) 10-17.

DISCLOSURE OF THE INVENTION

Problems to be Solved by the Invention

However, a technique to surely obtain a sufficient fire extinguishing effect by a metallocene has not been established; therefore, further researches have been required for realizing the practical use of a metallocene as a fire extinguishing agent.

The present invention has been made in view of the above circumstances, and the object of the present invention is to provide a novel fire extinguishing agent using a metallocene, which has an excellent fire extinguishing capability.

Means for Solving the Problems

In order to solve the aforementioned problems, the present invention provides a fire extinguishing agent comprising a metallocene and a dispersion medium, the metallocene being dispersed in the dispersion medium.

In the fire extinguishing agent of the present invention, the metallocene is preferably ferrocene.

In the fire extinguishing agent of the present invention, the concentration of the metallocene is preferably 70 ppm by weight to 20% by weight.

In the fire extinguishing agent of the present invention, the dispersion medium is preferably at least one member selected from the group consisting of an incombustible liquid and an incombustible powder.

In the fire extinguishing agent of the present invention, it is preferable that the dispersion medium is an incombustible liquid, and the concentration of the metallocene is 70 to 160 ppm by weight.

In the fire extinguishing agent of the present invention, it is preferable that the dispersion medium is water, and a dispersing agent is further contained.

In the fire extinguishing agent of the present invention, the dispersing agent is preferably a nonionic surfactant.

In the fire extinguishing agent of the present invention, the concentration of the nonionic surfactant is preferably 1 to 7 times the critical micelle concentration.

In the fire extinguishing agent of the present invention, it is preferable that a dispersion stability of the metallocene in the fire extinguishing agent is 1 to 20 in terms of a slope obtained by plotting times after production of the fire extinguishing agent in abscissa against reciprocal numbers of turbidity values of the fire extinguishing agent in ordinate.

In the fire extinguishing agent of the present invention, it is preferable that the dispersion medium is an incombustible powder, and the concentration of the metallocene is 550 ppm by weight to 20% by weight.

In the fire extinguishing agent of the present invention, the dispersion medium is preferably at least one member selected from the group consisting of ammonium sulfate, magnesium sulfate, potassium sulfate, ammonium dihydrogen phosphate, diammonium hydrogen phosphate, potassium phosphate, sodium chloride, potassium chloride, magnesium oxide, silicon dioxide, and alumina.

The present invention also provides a method for extinguishing fire, comprising supplying the fire extinguishing agent to a burning material.

Effects of the Invention

According to the present invention, there is provided a novel fire extinguishing agent using a metallocene, which has an excellent fire extinguishing capability, and a method for extinguishing fire using the same.

MODE FOR CARRYING OUT THE INVENTION

Figure 1:
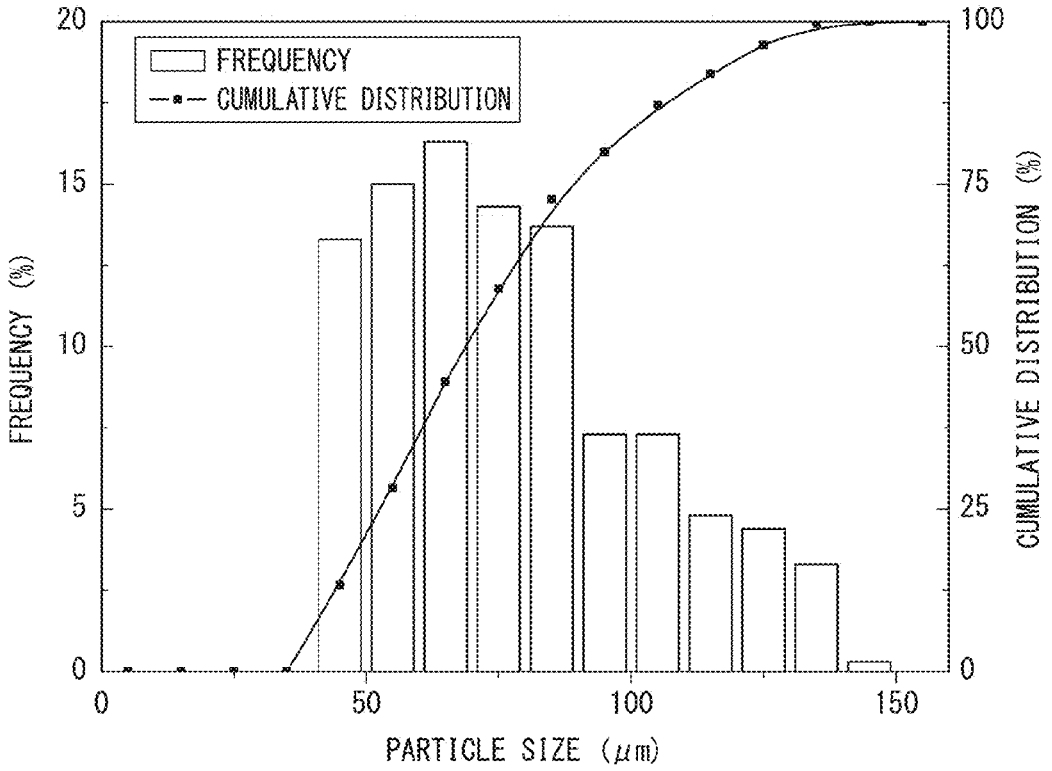
FIG. 1 shows a particle size distribution chart of pulverized ferrocene (1) used in the production of fire extinguishing agents in Examples 1 to 4.

The fire extinguishing agent of the present invention comprises a metallocene and a dispersion medium. In the fire extinguishing agent of the present invention, the metallocene is dispersed in the dispersion medium, whereby the fire extinguishing agent stably exhibits excellent fire extinguishing capability.

The metallocene contained in the fire extinguishing agent has a structure in which a metal atom is positioned between two cyclopentadienyl rings ($C_5H_5^-$), and any of conventional metallocenes can be used. Examples of the metal species in the metallocene include iron, nickel, cobalt, chromium, manganese, vanadium, ruthenium and osmium. The metallocene may further have coordinated thereto ligands other than the cyclopentadienyl rings. Examples of other ligands include acetylacetone type compounds, and pentamethyl cyclopentadiene type compounds, and benzene type compounds.

Concerning such metallocenes, as examples of bis(cyclopentadienyl) metal compounds, there can be mentioned [$Fe(C_5H_5)_2$ (ferrocene), [$Ni(C_5H_5)_2$] (nickelocene), [$Co(C_5H_5)_2$] (cobaltocene), [$Cr(C_5H_5)_2$] (chromocene), [$Mn(C_5H_5)_2$] (manganosene), [$V(C_5H_5)_2$] (vanadocene), [$Ru(C_5H_5)_2$] (ruthenocene), and [$Os(C_5H_5)_2$] (osmocene). Among these, ferrocene is preferred due to its low toxicity, inexpensiveness, etc.

The metallocene preferably has a median diameter of 5 to 80 μm, more preferably 10 to 70 μm. The metallocene in the form of such fine particles exhibits higher dispersibility in water. In the present specification, the term "median diameter" means a cumulative 50% particle diameter (D50) in a volume-based cumulative particle size distribution curve obtained as a result of measurement performed by a laser diffraction particle size distribution analyzer.

Further, the ratio of particles of 200 μM or smaller in the metallocene is preferably 90% by volume or more.

The aforementioned fire extinguishing agent may contain a single type of metallocene or two or more types of metallocene. When two or more types of metallocene are used, the combination of the types and the ratio thereof can be selected arbitrarily according to the purpose. When using a mixture of ferrocene and other metallocene, the ratio of ferrocene in the total weight of the metallocene is preferably 1% by weight or more, more preferably 10% by weight or more, and still more preferably 50% by weight or more.

The content of the metallocene in the fire extinguishing agent is preferably in the range of 70 ppm by weight to 20% by weight, more preferably 80 ppm by weight 10 w % by weight, particularly preferably 100 ppm by weight to 1% by weight. When the content of the metallocene is within this range, the fire extinguishing agent exhibits even higher fire extinguishing capability. As in the case of the conventional ammonium dihydrogen phosphate ($NH_4H_2PO_4$), the metallocene is presumed to exhibit an effect of suppressing combustion (fire extinguishing capability) by capturing radicals generated in a combustion system to terminate the chain reaction of the combustion. Further, by adjusting the content of the metallocene to be equal to or higher than the aforementioned lower limit, the metallocene can exhibit a more remarkable effect of suppressing combustion. Meanwhile, the metallocene itself is a combustible compound. Therefore, by adjusting the content of the metallocene to be equal to or lower than the aforementioned upper limit, the combustion of the metallocene itself can be suppressed such that a more remarkable effect of suppressing combustion can be achieved.

Thus, the aforementioned fire extinguishing agent exhibits an excellent fire extinguishing capability with the metallocene content being within an extremely low range.

The dispersion medium used in the present invention is preferably at least one member selected from the group consisting of an incombustible liquid and an incombustible powder. Here, the term "incombustible" means that the liquid and the powder do not react with oxygen, and there is no particular limitation on such a liquid and a powder as long as they do not react with oxygen. Further, the dispersion medium is preferred to be less corrosive and less toxic.

Examples of incombustible liquid used as the dispersion medium include water. The water used in the present invention is not particularly limited as long as it does not contain impurities of the type and in an amount such as would hinder the function of the fire extinguishing agent. From the viewpoint of cost and availability, it is preferred to use a common tap water.

When the dispersion medium is an incombustible liquid, the concentration of the metallocene is preferably 70 to 160 ppm by weight, more preferably 80 to 140 ppm by weight, especially preferably 90 to 130 ppm by weight.

When the dispersion medium is water, it is preferred that the fire extinguishing agent of the present invention further contains a dispersing agent. The dispersing agent is not particularly limited as long as it has an effect of dispersing the metallocene in water; for example, any of various known surfactants can be used as the dispersing agent.

The surfactant may be any of anionic surfactants, cationic surfactants and nonionic surfactants.

Examples of the anionic surfactants include sulfuric esters such as sodium lauryl sulfate, and sulfonic acid salts such as sodium alkylbenzene sulfonate.

Examples of the cationic surfactants include quaternary ammonium salts such as dodecyltrimethylammonium chloride.

Examples of the nonionic surfactants include glycerin fatty acid esters, sucrose fatty acid esters, sorbitan fatty acid esters, and acetylene alcohols. Here, the term "acetylene alcohols" means compounds each having a carbon-to-carbon triple bond (C≡C) and at least one hydroxyl group.

Among these surfactants, from the viewpoint of higher fire extinguishing capability of the extinguishing agent, the nonionic surfactant are preferable, acetylene alcohols are more preferable, and it is especially preferable to use any of acetylene alcohols represented by the following general formula (A) (hereinafter, sometimes referred to as "surfactant (A)"). With respect to the surfactant (A), when at least one of m and n is not 0, the surfactant (A) is an ethylene oxide adduct formed by the addition of ethylene oxide to hydroxyl groups of different types of surfactants (A).

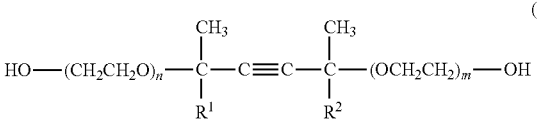

(A)

wherein each of $R^1$ and $R^2$ independently represents a hydrogen atom or a lower alkyl group, and each of m and n independently represents an integer of 0 or more.

With respect to the surfactant (A), it is preferred that each of $R^1$ and $R^2$ is independently an alkyl group having 1 to 6 carbon atoms, and each of m and n is independently an integer of 0 or 1 to 30. Further, m+n is preferably 1 to 50, and more preferably 1 to 30. It is especially preferred that m+n is 10 because the metallocene can be especially highly dispersed in the fire extinguishing agent, and the fire extinguishing agent exhibits even superior fire extinguishing capability. As the surfactant (A) where m+n is 10, Surfynol 465 (sold by Nissin Chemical Industry Co., Ltd., hereinafter sometimes referred to as "surfactant (1)") is available as a commercial product.

Further, as the surfactant (A) where both of m and n are 0, Surfynol 104 (sold by Nissin Chemical Industry Co., Ltd.) is available as a commercial product.

As other examples of commercially available surfactant, there can be mentioned various "Surfynol" surfactants (sold by Nissin Chemical Industry Co., Ltd.) such as Surfynol 485 (hereinafter, sometimes referred to as "surfactant (2)"), Olfine E1020 (sold by Nissin Chemical Industry Co., Ltd., hereinafter sometimes referred to as "surfactant (3)"), and Olfine PD201 (sold by Nissin Chemical Industry Co., Ltd., hereinafter sometimes referred to as "surfactant (4)"). Each of these is a nonionic surfactant by itself or contains a nonionic surfactant.

The aforementioned fire extinguishing agent may contain a single type of dispersing agent or two or more types of dispersing agent. When two or more types of dispersing agent are used, the combination of the types and the ratio thereof can be selected arbitrarily according to the purpose.

The content of the dispersing agent in the fire extinguishing agent is preferably in the range of 0.05 to 2.0% by weight, and more preferably 0.1 to 1.5% by weight. When the content of the dispersing agent is in the aforementioned range, the metallocene can be more finely dispersed in the fire extinguishing agent.

Especially when a surfactant is used as the dispersing agent, the concentration of the surfactant in the fire extinguishing agent is preferably 1 to 7 times the critical micelle concentration (cmc), more preferably 1.5 to 7 times the cmc, and especially preferably 2 to 7 times the cmc. Here, the critical micelle concentration can be measured by using a du Nouy surface tension meter (manufactured by Ito Corporation) or the like. When the concentration of the surfactant is not less than the above lower limit, the dispersion of the metallocene in the fire extinguishing agent (fire extinguishing capability of the fire extinguishing agent) is further improved. When the concentration of the surfactant is not more than 7 times the critical micelle concentration, the fire extinguishing capability of the fire extinguishing agent becomes higher while suppressing the excessive use of the surfactant.

The metallocene is a compound having a high lipid solubility, which when used alone, exhibits a very low solubility in water. Therefore, the fire extinguishing agent using water as a dispersion medium is inevitably accompanied with problems such as sedimentation or aggregation of the metallocene. Therefore, the metallocene has been regarded as being inherently unsuitable as a component of the fire extinguishing agent using water as a dispersion medium. For this reason, as mentioned above, the metallocene has conventionally been used in the form of a vapor or a solution in an organic solvent, and studied in that form for its fire extinguishing capability. In the present invention, by using the metallocene preferably in the form of fine particles and further combining it with a dispersant, it has become possible to disperse the metallocene in water, where the dispersibility of metallocene in water can be further improved by adjusting the type and amount of the dispersing agent and the like. As a result, it has become possible to realize a fire extinguishing agent with stable quality, where the sedimentation or aggregation of the metallocene is almost or completely suppressed.

When an incombustible liquid is used as the dispersion medium, the dispersion stability of the metallocene in the fire extinguishing agent is preferably 0 to 20, more preferably 0 to 10, and still more preferably 0 to 1 in terms of a slope obtained by plotting times after production of the fire extinguishing agent in abscissa against reciprocal numbers of turbidity values of the fire extinguishing agent in ordinate. More specifically, the dispersion stability of the metallocene is a slope obtained by linear approximation of the relationship of times (min) after production of the fire extinguishing agent plotted in abscissa (x axis) against reciprocal numbers of turbidity values ($NTU^{-1}$) of the fire extinguishing agent in ordinate (y axis). Since the reciprocal numbers of turbidity values correspond to the horizontal transparency (clearness), the dispersion stability can be paraphrased as temporal change of the horizontal transparency. Therefore, the higher value of the dispersion stability indicates the higher stability of the fire extinguishing agent as a dispersion system, and the less likelihood of aggregation.

When the dispersion medium is an incombustible powder, the concentration of the metallocene is preferably 550 ppm by weight to 20% by weight, more preferably 800 ppm by weight to 10% by weight, especially preferably 1,000 ppm by weight to 1% by weight. The particle size of the incombustible powder is not particularly limited as long as it is possible to uniformly disperse the metallocene; for example, the particle size may be within the range mentioned above as the range of average particle size of the metallocene.

The fire extinguishing agent may contain, if necessary, other components such as a dye, a pigment and a pH modifiers as well as the metallocene, the dispersion medium and the dispersing agent as long as the effects of the present invention are not impaired.

The fire extinguishing agent may contain a single type of the other component or two or more types of the other component. When two or more types of the other component are used, the combination of the types and the ratio thereof can be selected arbitrarily according to the purpose.

The content of the other component in the fire extinguishing agent is preferably up to 10% by weight, more preferably up to 5% by weight, and particularly preferably up to 3% by weight.

The fire extinguishing agent can be obtained by blending together the metallocene, the dispersion medium, the dispersing agent, and, if necessary, the other components, and sufficiently dispersing the metallocene in the resulting mixture.

The method for dispersing the metallocene during the blending is not particularly limited and may be suitably selected from the known methods. For example, when the dispersion medium is an incombustible liquid such as water, from the viewpoint of obtaining a higher dispersion effect, it is preferred to employ a method in which the mixture of the components such as the metallocene is subjected to an ultrasonic irradiation to disperse the metallocene, where the frequency is preferably 10 to 100 kHz.

The temperature for dispersing the metallocene during the blending with an incombustible liquid as the dispersion medium is not particularly limited as long as the metallocene can be sufficiently dispersed and the components do not deteriorate; however, for greater dispersion effect of the metallocenes, the temperature is preferably 20° C. or higher. Further, though influenced by the types of the components of the fire extinguishing agent, the higher the temperature for dispersing the metallocene, the higher the dispersion effect of metallocene; therefore, the temperature is more preferably 25° C. or higher, still more preferably 35° C. or higher, and particularly preferably 45° C. or higher. On the other hand, for improving the effect of suppressing the degradation of the components, the temperature is preferably 70° C. or lower, and more preferably 60° C. or lower.

The time for dispersing the metallocene during the blending with an incombustible liquid as the dispersion medium is also not particularly limited as long as the components do not deteriorate, and the dispersing operation may be continued until the metallocene is sufficiently dispersed, for example, for 10 to 60 minutes The method for mixing the components in the case of using an incombustible powder as the dispersion medium is not particularly limited as long as the metallocene can be uniformly dispersed; for example, various agitation methods such as milling using a ball mill can be employed.

The dispersion medium used in the present invention may be a mixture of the incombustible liquid and the incombustible powder. In such a case, the mixing ratio may be appropriately adjusted depending on the use of the fire extinguishing agent and the like, and the mixture may either be a solution or a slurry.

The fire extinguishing agent is preferably stored and used as being filled into a container made of a metal or the like as used for conventional fire extinguishing agents.

After the production, the fire extinguishing agent can be stably kept while maintaining sufficiently dispersed state of the metallocenes, but can even more stably exhibit the fire extinguishing capability by, if necessary, performing a general mixing operation before use. The dispersing operation may also be performed again before use.

The present invention also provides a method for extinguishing fire, comprising supplying the fire extinguishing agent to a burning material. As described above, the fire extinguishing agent of the present invention may be in any of various forms such as a slurry and a powder as well as a solution such an aqueous solution; therefore, the fire extinguishing agent can be used for extinguishing fire by any known method suitable for the form of the fire extinguishing agent. Regarding a fire extinguisher using the aforementioned fire extinguishing agent, the fire extinguisher may have a basic construction such that it has a container filled with the fire extinguishing agent and a discharge means, such as a spray nozzle, for releasing the fire extinguishing agent, the discharge means being provided in association with the container. The specific structure of the fire extinguisher may be designed based on any of conventional structures, in view of the form of the fire extinguishing agent and the specific purpose of fire extinguishing operation.

As in the case of conventional fire extinguishing agents, the fire extinguishing agent of the present invention exhibits high fire extinguishing capability when brought into contact with a targeted burning material. For bringing the fire extinguishing agent into contact with a burning material, for example, the fire extinguishing agent as such may be sprayed to the burning material, or may be sprayed in the form of a mist, which may be appropriately chosen depending on the specific type of burning. For example, in the case of ordinary fires, the fire extinguishing agent may be brought into contact with the burning material by any method; however, in the case of oil fires and electrical fires, the fire extinguishing agent is preferably sprayed in the form of a mist.

As a specific example of the fire extinguishing method to be employed for extinguishing ordinary fire using the aforementioned fire extinguishing agent in the form of an aqueous dispersion, there can be mentioned a method in which the fire extinguishing agent of the present invention is discharged to the site of fire. There is no particular limitation as to the method of discharging the fire extinguishing agent, and it may be sprinkled from the sky, discharged from a fire extinguishing vehicle, or sprayed by human power using a bucket or the like.

Further, oil fires represented by frying oil fire may be extinguished by a method using a powder fire extinguisher or an aerosol-type simple extinguishing equipment.

EXAMPLES

Hereinbelow, the present invention will be described in more detail by way of specific examples.

Example 1

<Production of Fire Extinguishing Agent>

(Pulverization of Ferrocene)

Commercially available ferrocene was pulverized in an agate mortar. The resulting ferrocene particles were sieved through a 100 μm mesh sieve and further sieved through a 50 μm mesh sieve. The particles remaining on the latter sieve (hereinafter, referred to as "pulverized ferrocene (1)") were taken as a material for the production of the fire extinguishing agent. Through an optical microscope ("DMI-300B", manufactured by Leica, Inc.), an image of the pulverized ferrocene (1) was obtained, and the areas of particles of the pulverized ferrocene (1) were measured using an image analysis software ("ImageJ ver. 1.45"), based on which the corresponding particle sizes were calculated to obtain a particle size distribution which was then used to prepare a particle size distribution diagram. The particle size distribution diagram is shown in FIG. 1.

From the results shown in FIG. 1, the median size of the pulverized ferrocene (1) was found to be 65 μm.

(Production of Fire Extinguishing Agent)

Into a volumetric flask of 100 mL were added the pulverized ferrocene (1), water (100 mL), a surfactant (1) ("Surfynol 465", manufactured by Nissin Chemical Industry Co., Ltd.) as a dispersing agent. The temperature of the resulting mixture was adjusted to 50° C., followed by ultrasonic irradiation (40 kHz) for 20 minutes to sufficiently disperse the contents, thereby obtaining a fire extinguishing agent as a uniform dispersion. Here, as shown in Table 1, the amount of the pulverized ferrocene (1) added was adjusted such that the concentration thereof in the dispersion became 100 ppm.

Further, the amount of the surfactant (1) added was adjusted such that the concentration thereof in the dispersion became 0.2% by weight.

<Evaluation of Fire Extinguishing Capability of Fire Extinguishing Agent>

Figure 2:
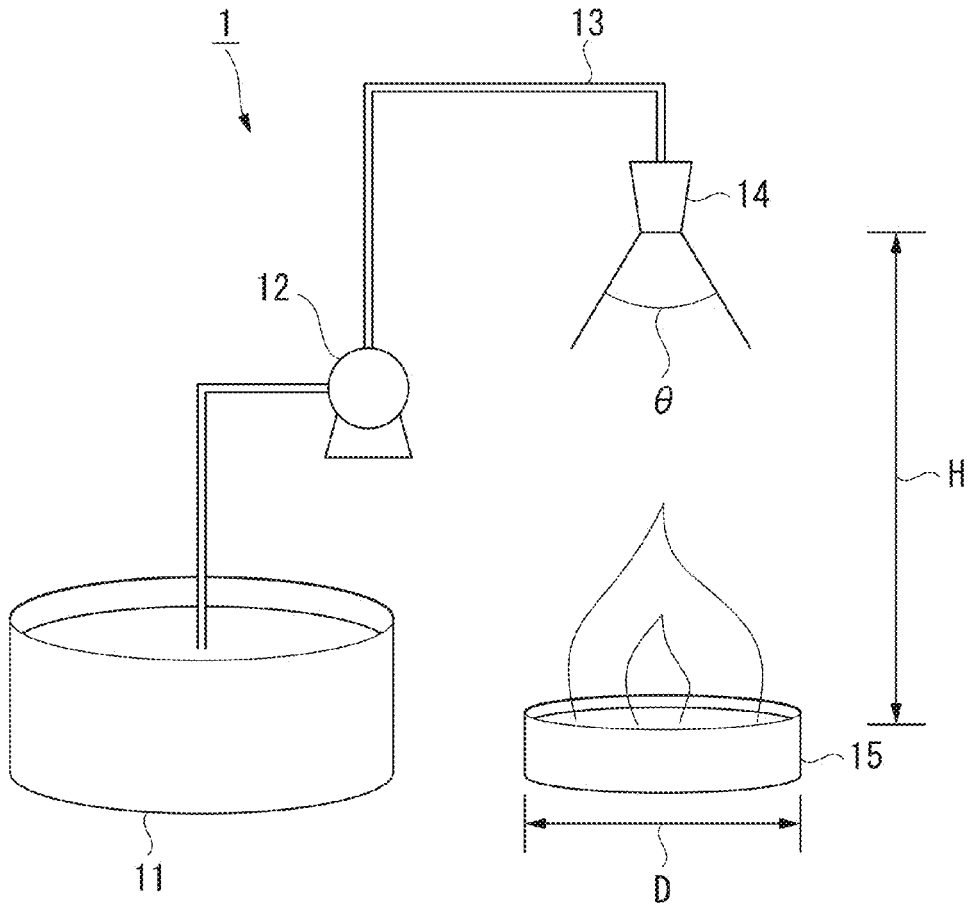
FIG. 2 is a schematic view showing an apparatus for evaluating the fire extinguishing capability of fire extinguishing agents, which are used in Examples 1 to 4 and Comparative Example 1.

Using an evaluation apparatus shown in FIG. 2, the fire extinguishing capability of the obtained fire extinguishing agent was evaluated.

The evaluation apparatus is composed mainly of a fire extinguishing agent holder 11 for holding the fire extinguishing agent to be evaluated, a nozzle 14 for spraying the fire extinguishing agent, a pipe 13 for connecting the fire extinguishing agent holder 11 and the nozzle 14, a pump 12 for transporting the fire extinguishing agent from the fire extinguishing agent holder 11 to the nozzle 14, which is inserted at a middle portion of the pipe 13, a burning material holder 15 for holding a burning material to which the fire extinguishing agent is sprayed. The nozzle 14 is adapted to be capable of spraying a liquid with a spread angle of 60° at a maximum. Further, the burning material holder 15 is a container having an inner diameter D of 83 mm.

In the burning material holder 15 of the evaluation apparatus 1, n-heptane (80 mL) was held as a liquid combustible material while adjusting the distance H between the liquid surface of the n-heptane and the tip of the nozzle 14 to be 50 cm. Then, the n-heptane was ignited and left as it was for 20 seconds so as to stabilize the flame. To the flame was sprayed the fire extinguishing agent obtained above through the nozzle 14 at a flow rate of about 240 mL/min. Then, the condition of the n-heptane was visually observed until 45 seconds after the initiation of spraying of the fire extinguishing agent.

The above fire extinguishing operation was repeated more than five times in total, to evaluate the fire extinguishing capability of the fire extinguishing agent.

Figure 3:
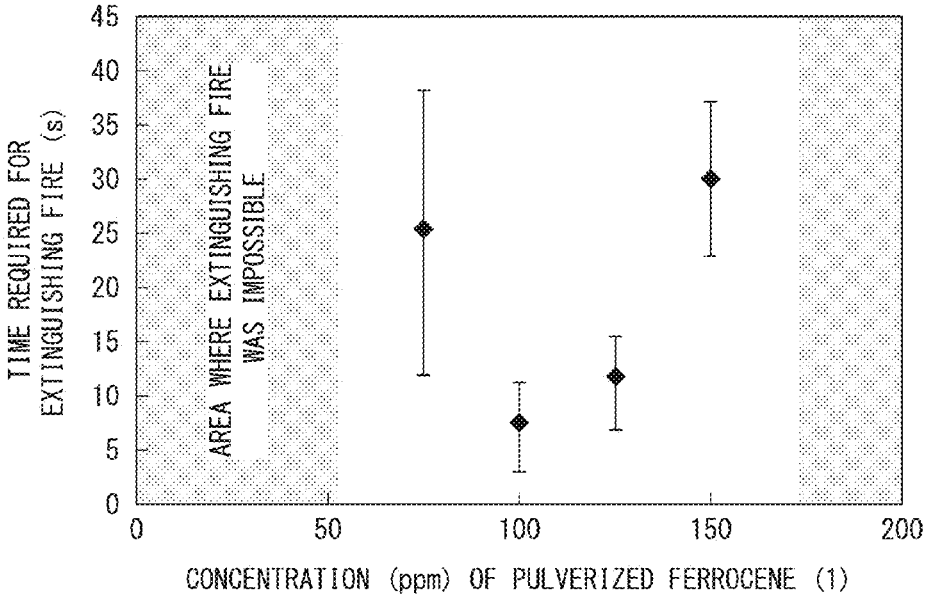
FIG. 3 is a graph showing the results of evaluation of the fire extinguishing capability of fire extinguishing agents obtained in Examples 1 to 4 and Comparative Example 1.

The results are shown in Table 1 and FIG. 3. In Table 1, the results of the evaluations on the fire extinguishing capability are classified into ○, Δ and x which have the following meanings respectively.

○: In all of the fire-extinguishing operations, the fire could be extremely quickly extinguished within 45 seconds after the initiation of spraying.

Δ: In all of the fire-extinguishing operations, the fire could be quickly extinguished within 45 seconds after the initiation of spraying.

x: In all of the fire-extinguishing operations, the fire could not be extinguished within 45 seconds after the initiation of spraying.

Example 2

As shown in Table 1, a fire extinguishing agent was produced in the same manner as in Example 1, except that the concentration of the pulverized ferrocene (1) was changed from 100 ppm to 125 ppm, and the fire extinguishing capability thereof was evaluated in the same manner as in Example 1. The results are shown in Table 1 and FIG. 3.

Example 3

As shown in Table 1, a fire extinguishing agent was produced in the same manner as in Example 1, except that the concentration of the pulverized ferrocene (1) was changed from 100 ppm to 150 ppm, and the fire extinguishing capability thereof was evaluated in the same manner as in Example 1. The results are shown in Table 1 and FIG. 3.

Example 4

As shown in Table 1, a fire extinguishing agent was produced in the same manner as in Example 1, except that the concentration of the pulverized ferrocene (1) was changed from 100 ppm to 75 ppm, and the fire extinguishing capability thereof was evaluated in the same manner as in Example 1. The results are shown in Table 1 and FIG. 3.

Comparative Example 1

As shown in Table 1, a fire extinguishing agent was produced in the same manner as in Example 1, except that the pulverized ferrocene (1) was not used, and the fire extinguishing capability thereof was evaluated in the same manner as in Example 1. The results are shown in Table 1 and FIG. 3.

TABLE 1

| | Components and concentrations thereof in the fire extinguishing agent | | Result of evaluation of fire extinguishing capability |
|---|---|---|---|
| | Metallocene (ppm) | Dispersing agent (% by weight) | |
| Example 1 | Pulverized ferrocene (1) (100) | Surfactant (1) (0.2) | ○ |
| Example 2 | Pulverized ferrocene (1) (125) | | ○ |
| Example 3 | Pulverized ferrocene (1) (150) | | Δ |
| Example 4 | Pulverized ferrocene (1) (75) | | Δ |
| Comparative Example 1 | — | | X |

As is apparent from FIG. 3, in each of Examples 1 and 2, the fire could be extremely quickly extinguished within 45 seconds after the initiation of spraying in all of the fire-extinguishing operations. Further, in each of Examples 3 and 4, though more time was needed than in Examples 1 and 2, the fire could be quickly extinguished within 45 seconds after the initiation of spraying in all of the fire-extinguishing operations.

On the other hand, in Comparative Example 1, the fire extinguishing agent without ferrocene did not exhibit fire extinguishing capability, and it was also confirmed that the surfactant (1) had no fire extinguishing capability. This result confirms that the excellent fire extinguishing capability observed in Examples 1 to 4 is attributable to the pulverized ferrocene (1).

Example 5

<Production of Fire Extinguishing Agent>

(Pulverization of Ferrocene)

By using a planetary ball mill, a commercially available ferrocene was subjected to wet pulverization at 400 rpm for 45 minutes, thereby obtaining pulverized ferrocene (hereinafter, referred to as "pulverized ferrocene (2)"). Using a laser diffraction particle size distribution analyzer ("SALD-7000", manufactured by Shimadzu Corporation), the particle size distribution of the pulverized ferrocene (2) was measured to prepare a particle size distribution diagram. The obtained particle size distribution diagram is shown in FIG. 4.

Figure 4:
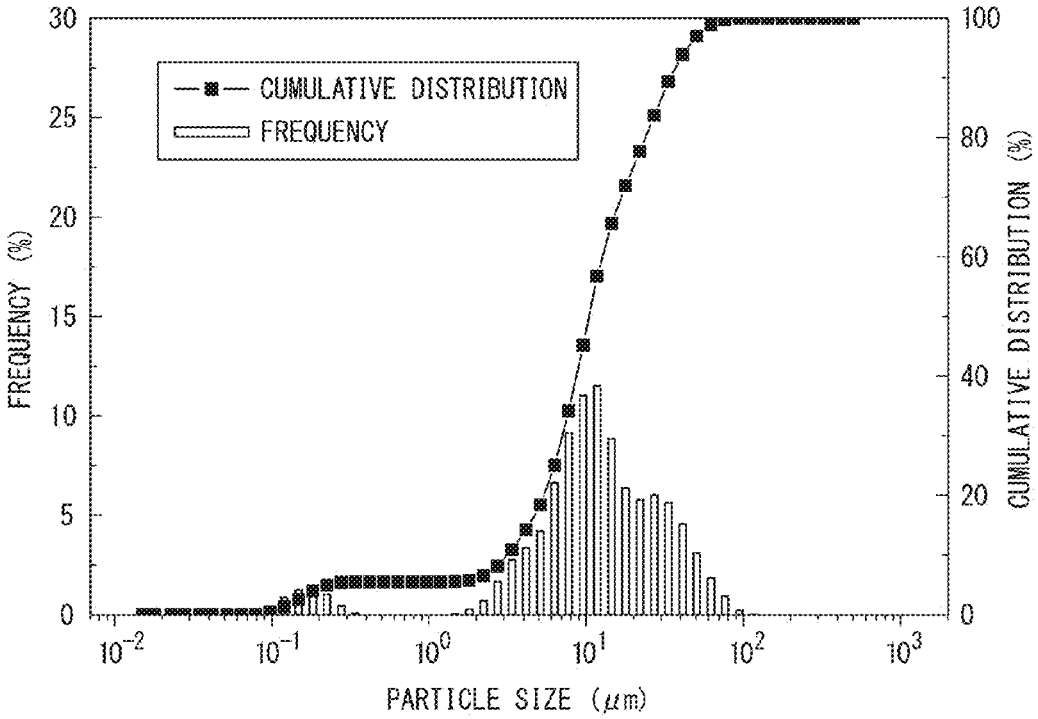
FIG. 4 shows a particle size distribution chart of pulverized ferrocene (2) used in the production of fire extinguishing agents in Examples 5 to 12.

From the results shown in FIG. 4, it was confirmed that the pulverized ferrocene (2) has a bimodal particle size distribution having a small peak in the vicinity of the particle size of 0.2 μm as well as the main peak, and has a median size of 10.4 μm.

Further, a pulverized ferrocene (3) was obtained in the same manner as in the production of the pulverized ferrocene (2) except that the commercially available ferrocene was subjected to wet pulverization at 300 rpm instead of 400 rpm, and the particle size distribution of the pulverized ferrocene (3) was measured to prepare a particle size distribution diagram. The obtained particle size distribution diagram is shown in FIG. 5.

Figure 5:
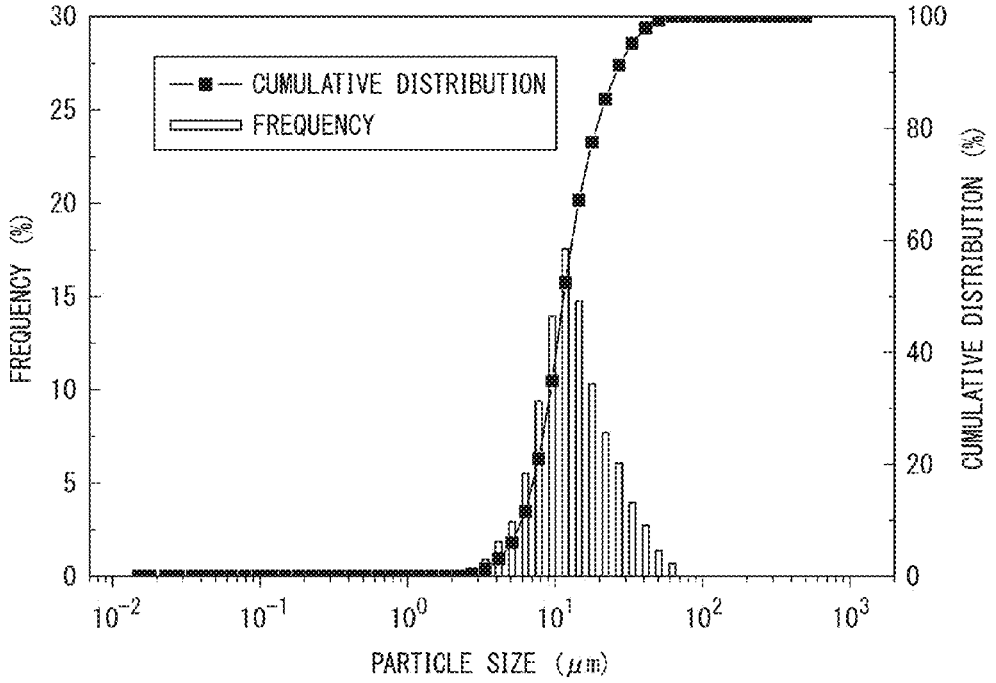
FIG. 5 shows a particle size distribution chart of pulverized ferrocene (3) used in the production of fire extinguishing agents in Examples 5 to 12.

From the results shown in FIG. 5, the particle size distribution was found to be sharp, and the median size of the pulverized ferrocene (3) was found to be 11.4 μm.

Further, commercially available ferrocene was pulverized in an agate mortar. The resulting ferrocene particles were sieved through a 75 μm mesh sieve, a 53 μm mesh sieve and a 38 μm mesh sieve. The particles that had passed through 53 μM mesh sieve and remained on the 38 μm mesh sieve (hereinafter, referred to as "pulverized ferrocene (4)") were taken as a material for the production of the fire extinguishing agent. With respect to the pulverized ferrocene (4), the particle size distribution was measured in the same manner as in the case of the pulverized ferrocene (2) to prepare a particle size distribution diagram. The obtained particle size distribution diagram is shown in FIG. 6.

Figure 6:
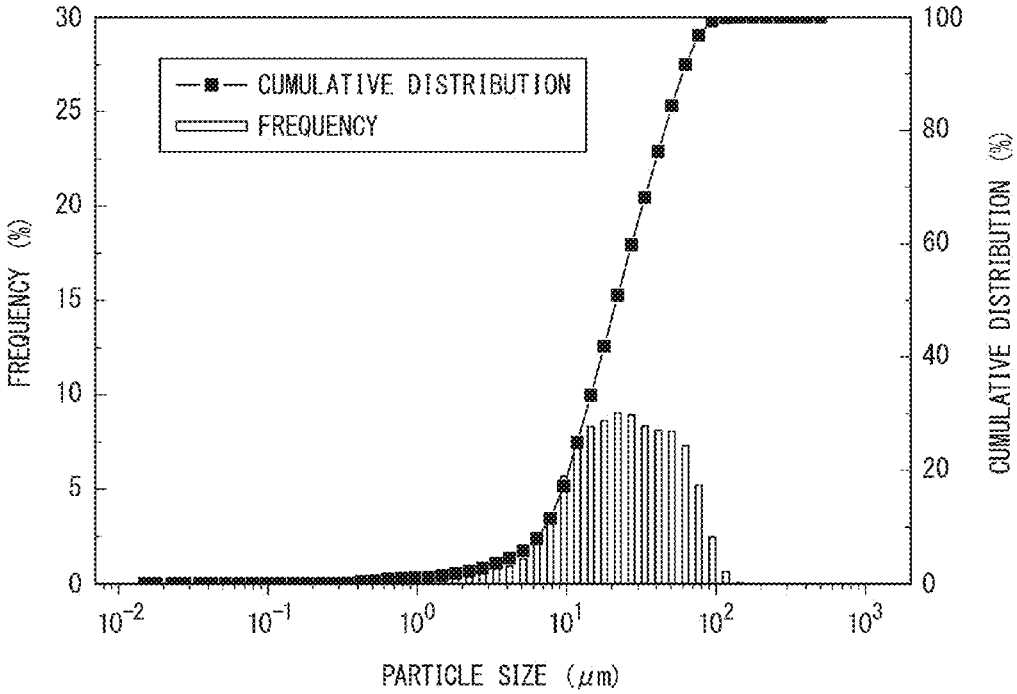
FIG. 6 shows a particle size distribution chart of pulverized ferrocene (4) used in the production of fire extinguishing agents in Examples 5 to 12.

From the results shown in FIG. 6, the particle size distribution of the pulverized ferrocene (4) was found to be broad, and the median particle size of the pulverized ferrocene (4) was found to be 21.5 μM.

(Production of Fire Extinguishing Agent)

Into an Erlenmeyer flask of 100 mL were added the pulverized ferrocene (2), the pulverized ferrocene (3) or the pulverized ferrocene (4) as well as water (100 mL) and a surfactant (1) as a dispersing agent. The temperature of the resulting mixture was adjusted to 50° C., followed by ultrasonic irradiation (40 kHz) for 20 minutes to sufficiently disperse the contents, thereby obtaining a fire extinguishing agent as a uniform dispersion. Here, as shown in Table 2, the amount of the pulverized ferrocene (2), (3) or (4) added was adjusted such that the concentration thereof in the dispersion became 100 ppm. Further, the amount of the surfactant (1) added was adjusted such that the concentration thereof in the dispersion became 0.4% by weight. The critical micelle concentration of the surfactant (1) was measured in advance by using a du Nouy surface tension meter (manufactured by Ito Corporation).

<Evaluation of Fire Extinguishing Capability of Fire Extinguishing Agent>

Using the evaluation apparatus shown in FIG. 2, the fire extinguishing capability of the obtained fire extinguishing agent was evaluated in the same manner as in Example 1 except that the following modifications were made with respect to the evaluation apparatus 1: a burning material holder 15 having an inner diameter D of 82 mm was used, and the distance H between the liquid surface of the n-heptane (in the burning material holder 15) and the tip of the nozzle 14 was adjusted to be 60 cm. Then, n-heptane was ignited and left as it was for 10 seconds so as to stabilize the flame. To the flame was sprayed the fire extinguishing agent obtained above through the nozzle 14 at a flow rate of about 250 mL/min. Then, the condition of the n-heptane was visually observed until 20 seconds after the initiation of spraying of the fire extinguishing agent.

Figure 7:
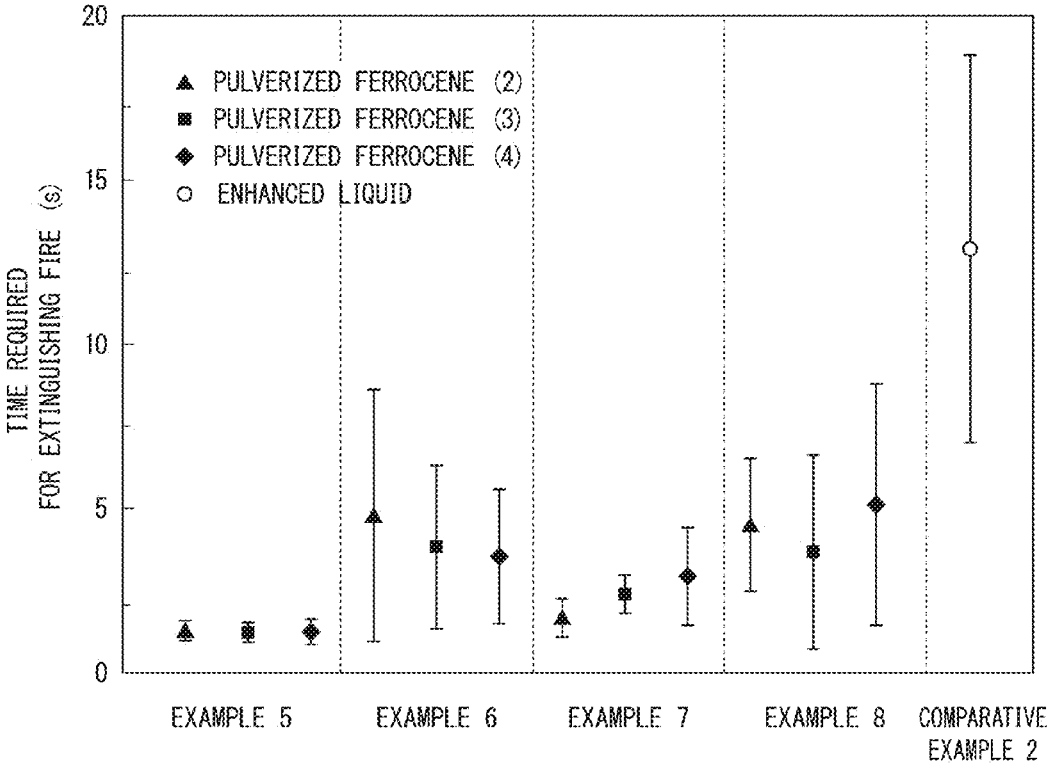
FIG. 7 is a graph showing the results of evaluation of the fire extinguishing capability of fire extinguishing agents obtained in Examples 5 to 8 and Comparative Example 2.

The above fire extinguishing operation was repeated more than five times in total, to evaluate the fire extinguishing capability of the fire extinguishing agent. The results are shown in FIG. 7.

Example 6

As shown in Table 2, a fire extinguishing agent was produced in the same manner as in Example 5, except that the surfactant (2) ("Surfynol 485" manufactured by Nissin Chemical Industry CO., Ltd.) was used instead of the surfactant (1), and the fire extinguishing capability thereof was evaluated in the same manner as in Example 5.

Further, the amount of the surfactant (2) added was adjusted such that the concentration thereof in the dispersion became 0.2% by weight. The results are shown in FIG. 7.

Example 7

As shown in Table 2, a fire extinguishing agent was produced in the same manner as in Example 5, except that the surfactant (3) ("Olfine E1020" manufactured by Nissin Chemical Industry CO., Ltd.) was used instead of the surfactant (1), and the fire extinguishing capability thereof was evaluated in the same manner as in Example 5. Further, the amount of the surfactant (3) added was adjusted such that the concentration thereof in the dispersion became 0.2% by weight. The results are shown in FIG. 7.

Example 8

As shown in Table 2, a fire extinguishing agent was produced in the same manner as in Example 5, except that the surfactant (4) ("Olfine PD201" manufactured by Nissin Chemical Industry Co., Ltd.) was used instead of the surfactant (1), and the fire extinguishing capability thereof was evaluated in the same manner as in Example 5. Further, the amount of the surfactant (4) added was adjusted such that the concentration thereof in the dispersion became 0.2% by weight. The results are shown in FIG. 7.

Comparative Example 2

The fire extinguishing capability of an enhanced liquid (main component: potassium carbonate) as a conventional fire extinguishing agent was evaluated in the same manner as in Example 5. The results are shown in FIG. 7.

TABLE 2

| | Components and concentrations thereof in the fire extinguishing agent | |
|---|---|---|
| | Metallocene (ppm) | Dispersing agent (% by weight) |
| Example 5 | Pulverized ferrocene (2) (100)<br>Pulverized ferrocene (3) (100)<br>Pulverized ferrocene (4) (100) | Surfactant (1) (0.4) |

TABLE 2-continued

| | Components and concentrations thereof in the fire extinguishing agent | |
|---|---|---|
| | Metallocene (ppm) | Dispersing agent (% by weight) |
| Example 6 | Pulverized ferrocene (2) (100)<br>Pulverized ferrocene (3) (100)<br>Pulverized ferrocene (4) (100) | Surfactant (2) (0.2) |
| Example 7 | Pulverized ferrocene (2) (100)<br>Pulverized ferrocene (3) (100)<br>Pulverized ferrocene (4) (100) | Surfactant (3) (0.2) |
| Example 8 | Pulverized ferrocene (2) (100)<br>Pulverized ferrocene (3) (100)<br>Pulverized ferrocene (4) (100) | Surfactant (4) (0.2) |

As apparent from FIG. 7, in Example 5, there was almost no difference in the extinguishing time in all of the fire-extinguishing operations (variation was small) whichever of the pulverizing ferrocenes (2) to (4) was used. For example, in the case of using the pulverized ferrocene (2), the minimum extinguishing time was 0.8 seconds, the average extinguishing time was 1.2 seconds, and the standard deviation (SD) was 0.4. Also in the case of using the pulverized ferrocene (4), the average extinguishing time was 1.2 seconds, and the standard deviation (SD) was 0.4. Since almost no difference was observed in the extinguishing time between the pulverized ferrocenes (2) to (4), it was confirmed that the particle size of ferrocene does not affect the fire extinguishing capability of the fire extinguishing agent as long as the ferrocene is sufficiently dispersed.

On the other hand, in each of Examples 6 to 8, though the extinguishing time varied more than in Example 5, the fire could be quickly extinguished within 20 seconds after the initiation of spraying in all of the fire-extinguishing operations. Further, no data suggested that the particle size of the ferrocene has any influence on the fire extinguishing capability of the fire extinguishing agent.

In Examples 6 to 8, it was also confirmed that the variation of the extinguishing time is suppressed more as the degree of dispersion of the pulverized ferrocene increases.

On the other hand, in Comparative Example 2, the average extinguishing time was 12.9 seconds, and the standard deviation (SD) was 5.9, thereby indicating that the extinguishing capability in Comparative Example 2 was clearly inferior to those in Examples 5 to 8.

A fire extinguishing agent was produced in the same manner as in Examples 5 to 8, except that the pulverized ferrocenes (2) to (4) were not used, and the fire extinguishing capability thereof was evaluated in the same manner as in Example 5. As a result, the fire could be extinguished within 20 seconds after the initiation of spraying in all of the fire-extinguishing operations, whereby it was confirmed that the surfactants (1) to (4) do not have a fire extinguishing capability.

Example 9

<Production of Fire Extinguishing Agent and Evaluation of Fire Extinguishing Capability Thereof>

Into an Erlenmeyer flask of 100 mL were added, as shown in Table 3, the pulverized ferrocene (2), the pulverized ferrocene (3) or the pulverized ferrocene (4) as well as water (100 mL) and the surfactant (1), the surfactant (2), the surfactant (3) or the surfactant (4) as a dispersing agent. The temperature of the resulting mixture was adjusted to 30° C., 40° C. or 50° C., followed by ultrasonic irradiation (40 kHz) for 20 minutes, thereby obtaining a fire extinguishing agent. The amount of each of the pulverized ferrocenes (2) to (4) added was adjusted such that the concentration thereof in the dispersion became 20 ppm. Further, the amount of each of the surfactants (1) to (4) added was adjusted such that the concentration thereof in the dispersion became 1, 2 or 5 times the critical micelle concentration (cmc).

The critical micelle concentration of each of the surfactants (1) to (4) was measured in advance by using a du Nouy surface tension meter.

Then, the fire extinguishing agent immediately after production was allowed to stand at room temperature for 20 minutes, whereafter the fire extinguishing agent was visually observed to evaluate the dispersibility of ferrocene (pulverized ferrocenes (2) to (4)) according to the following criteria. The results are shown in Table 3.

(Criteria for Evaluation of Dispersibility)

○: Ferrocene was stably dispersed.

Δ: Though small amount of ferrocene precipitated, an evaluable dispersion could be obtained.

x: Ferrocene was not dispersed by the ultrasonic irradiation.

TABLE 3

| | Components and concentrations thereof in fire extinguishing agent | | | |
|---|---|---|---|---|
| | Metallocene (ppm) | Dispersing agent (Ratio thereof to cmc) | Dispersing temperature (° C.) | Result of evaluation of dispersibility |
| Example 9 | Pulverized ferrocene (2) (20) | Surfactant (1) (1) | 30 | Δ |
| | | | 40 | ○ |
| | | | 50 | ○ |
| | | Surfactant (1) (2) | 30 | Δ |
| | | | 40 | ○ |
| | | | 50 | ○ |
| | | Surfactant (1) (5) | 30 | Δ |
| | | | 40 | ○ |
| | | | 50 | ○ |
| | Pulverized ferrocene (3) (20) | Surfactant (1) (1) | 30 | Δ |
| | | | 40 | Δ |
| | | | 50 | ○ |
| | | Surfactant (1) (2) | 30 | Δ |
| | | | 40 | Δ |
| | | | 50 | ○ |
| | | Surfactant (1) (5) | 30 | Δ |
| | | | 40 | ○ |
| | | | 50 | ○ |
| | Pulverized ferrocene (4) (20) | Surfactant (1) (1) | 30 | Δ |
| | | | 40 | Δ |
| | | | 50 | Δ |
| | | Surfactant (1) (2) | 30 | Δ |
| | | | 40 | Δ |
| | | | 50 | Δ |
| | | Surfactant (1) (5) | 30 | Δ |
| | | | 40 | Δ |
| | | | 50 | ○ |

Example 10

A fire extinguishing agent was produced in the same manner as in Example 9, except that the conditions were modified as shown in Table 4, and the dispersibility of the ferrocene was evaluated. The results are shown in Table 4.

TABLE 4

| | Components and concentrations thereof in fire extinguishing agent | | | |
|---|---|---|---|---|
| | Metallocene (ppm) | Dispersing agent (Ratio thereof to cmc) | Dispersing temperature (° C.) | Result of evaluation of dispersibility |
| Example 10 | Pulverized ferrocene (2) (20) | Surfactant (2) (1) | 30 | Δ |
| | | | 40 | Δ |
| | | | 50 | ○ |
| | | Surfactant (2) (2) | 30 | Δ |
| | | | 40 | Δ |
| | | | 50 | ○ |
| | | Surfactant (2) (5) | 30 | Δ |
| | | | 40 | Δ |
| | | | 50 | ○ |
| | Pulverized ferrocene (3) (20) | Surfactant (2) (1) | 30 | Δ |
| | | | 40 | Δ |
| | | | 50 | Δ |
| | | Surfactant (2) (2) | 30 | Δ |
| | | | 40 | Δ |
| | | | 50 | Δ |
| | | Surfactant (2) (5) | 30 | Δ |
| | | | 40 | ○ |
| | | | 50 | ○ |
| | Pulverized ferrocene (4) (20) | Surfactant (2) (1) | 30 | X |
| | | | 40 | X |
| | | | 50 | Δ |
| | | Surfactant (2) (2) | 30 | X |
| | | | 40 | Δ |
| | | | 50 | Δ |
| | | Surfactant (2) (5) | 30 | Δ |
| | | | 40 | ○ |
| | | | 50 | ○ |

Example 11

A fire extinguishing agent was produced in the same manner as in Example 9, except that the conditions were modified as shown in Table 5, and the dispersibility of the ferrocene was evaluated. The results are shown in Table 5.

TABLE 5

| | Components and concentrations thereof in fire extinguishing agent | | | |
|---|---|---|---|---|
| | Metallocene (ppm) | Dispersing agent (Ratio thereof to cmc) | Dispersing temperature (° C.) | Result of evaluation of dispersibility |
| Example 11 | Pulverized ferrocene (2) (20) | Surfactant (3) (1) | 30 | Δ |
| | | | 40 | Δ |
| | | | 50 | Δ |
| | | Surfactant (3) (2) | 30 | Δ |
| | | | 40 | Δ |
| | | | 50 | ○ |
| | | Surfactant (3) (5) | 30 | Δ |
| | | | 40 | Δ |
| | | | 50 | ○ |
| | Pulverized ferrocene (3) (20) | Surfactant (3) (1) | 30 | X |
| | | | 40 | Δ |
| | | | 50 | Δ |
| | | Surfactant (3) (2) | 30 | X |
| | | | 40 | Δ |
| | | | 50 | ○ |
| | | Surfactant (3) (5) | 30 | X |
| | | | 40 | Δ |
| | | | 50 | Δ |
| | Pulverized ferrocene (4) (20) | Surfactant (3) (1) | 30 | Δ |
| | | | 40 | Δ |
| | | | 50 | Δ |
| | | Surfactant (3) (2) | 30 | Δ |
| | | | 40 | Δ |
| | | | 50 | Δ |
| | | Surfactant (3) (5) | 30 | Δ |
| | | | 40 | Δ |
| | | | 50 | Δ |

Example 12

A fire extinguishing agent was produced in the same manner as in Example 9, except that the conditions were modified as shown in Table 6, and the dispersibility of the ferrocene was evaluated. The results are shown in Table 6.

TABLE 6

| | Components and concentrations thereof in fire extinguishing agent | | | |
|---|---|---|---|---|
| | Metallocene (ppm) | Dispersing agent (Ratio thereof to cmc) | Dispersing temperature (° C.) | Result of evaluation of dispersibility |
| Example 12 | Pulverized ferrocene (2) (20) | Surfactant (4) (1) | 30 | Δ |
| | | | 40 | Δ |
| | | | 50 | ○ |
| | | Surfactant (4) (2) | 30 | Δ |
| | | | 40 | Δ |
| | | | 50 | ○ |
| | | Surfactant (4) (5) | 30 | Δ |
| | | | 40 | ○ |
| | | | 50 | ○ |
| | Pulverized ferrocene (3) (20) | Surfactant (4) (1) | 30 | Δ |
| | | | 40 | Δ |
| | | | 50 | ○ |
| | | Surfactant (4) (2) | 30 | Δ |
| | | | 40 | Δ |
| | | | 50 | ○ |
| | | Surfactant (4) (5) | 30 | Δ |
| | | | 40 | ○ |
| | | | 50 | ○ |
| | Pulverized ferrocene (4) (20) | Surfactant (4) (1) | 30 | X |
| | | | 40 | Δ |
| | | | 50 | Δ |
| | | Surfactant (4) (2) | 30 | X |
| | | | 40 | Δ |
| | | | 50 | Δ |
| | | Surfactant (4) (5) | 30 | X |
| | | | 40 | Δ |
| | | | 50 | ○ |

As apparent from Tables 3 to 6, whichever of the dispersing agents was used, the dispersibility of ferrocene at dispersing temperature of 50° C. was almost satisfactory. Further, whichever of the dispersing agents was used, there was a tendency that the smaller the particle size of ferrocene (i.e., in the order of from the pulverized ferrocene (1), the pulverized ferrocene (2), the pulverized ferrocene (3)), the higher the dispersibility of ferrocene. Furthermore, whichever of the dispersing agents was used, there was a tendency that the higher the concentration of the dispersing agent, the higher the dispersibility of ferrocene. Thus, it has been confirmed that, whichever of the dispersing agents is used, the dispersibility of the ferrocene can be controlled by adjusting at least one of the ferrocene particle size, the concentration of the dispersing agent and the dispersing temperature.

Example 13

<Production of Fire Extinguishing Agent>

(Pulverization of Ferrocene)

Commercially available ferrocene was pulverized in an agate mortar. The resulting ferrocene particles were sieved through a 250 μm mesh sieve and further sieved through a 180 μm mesh sieve. The particles remaining on the latter sieve (hereinafter, referred to as "pulverized ferrocene (5)") were taken as a material for the production of the fire extinguishing agent. The median size of the pulverized ferrocene (5) was measured in the same manner as in Example 1 and was found to be 30.9 μm.

(Production of Fire Extinguishing Agent)

The pulverized ferrocene (5) and ammonium sulfate (median diameter: 22.2 μm) were homogeneously mixed by a ball mill to prepare fire extinguishing agents having different ferrocene concentrations as shown in Table 7.

<Evaluation of Fire Extinguishing Capability of Fire Extinguishing Agent>

1.0 kg of ammonium sulfate alone or the obtained fire extinguishing agent was filled into a commercially available ABC powder fire extinguisher (pressure type) (model number YP-4, manufactured by Yamato Protec Corporation), to evaluate the fire extinguishing capability of the fire extinguishing agent.

The fire extinguishing test was carried out using the following models according to Ordinance for setting technical standards pertaining to fire extinguishers (Ordinance of the Ministry of Home Affairs No. 27 of Sep. 17, 1964).

Flame model B-1: fire bowl of 0.2 $m^2$, n-heptane as fuel

Flame model A-0.5: cedar materials×36

The distance between the burning model and the tip end of extinguisher nozzle 14 was set to be 1 to 2 m, and the fire extinguishing agent was sprayed towards the model to evaluate whether or not the fire could be extinguished. The fire was judged to have been completely extinguished when the fire could be extinguished within 10 seconds, and the fire did not return. The results are categorized into: ○ when the fire could be extinguished, and x when the fire could not be extinguished. The results are shown in Table 7.

TABLE 7

| | Ferrocene concentration (ppm) | | | |
|---|---|---|---|---|
| | 0 | 1,000 | 3,000 | 10,000 |
| Flame model B-1 | X | ○ | ○ | ○ |
| Flame model A-0.5 | — | — | — | ○ |

INDUSTRIAL APPLICABILITY

The present invention is applicable in the field of a fire extinguishing agent.

DESCRIPTION OF THE REFERENCE SIGNS

1 Evaluation apparatus
11 Fire extinguishing agent holder
12 Pump
13 Pipe
14 Nozzle
15 Burning material holder
θ Spread angle of fire extinguishing agent sprayed through nozzle
H Distance between liquid surface of combustible liquid and tip of nozzle
D Inner diameter of burning material holder

The invention claimed is:

1. A fire extinguishing agent comprising a metallocene, a dispersion medium and a dispersing agent, the metallocene being dispersed in the dispersion medium, wherein:

the content of the metallocene is 70 to 160 ppm by weight, the dispersion medium is water, and the dispersing agent is at least one nonionic surfactant selected from the group consisting of glycerin fatty acid esters, sucrose fatty acid esters, sorbitan fatty acid esters, and acetylene alcohols.

2. The fire extinguishing agent according to claim 1, wherein the metallocene is ferrocene.

3. The fire extinguishing agent according to claim 1, wherein the concentration of the nonionic surfactant is 1 to 7 times the critical micelle concentration.

4. The fire extinguishing agent according to claim 1, wherein a dispersion stability of the metallocene in the fire extinguishing agent is 1 to 20 in terms of a slope obtained by linear approximation of a curve obtained by plotting times (min.) after production of the fire extinguishing agent in abscissa against reciprocal numbers of turbidity values ($NTU^{-1}$) of the fire extinguishing agent in ordinate.

5. A method for extinguishing fire, comprising supplying the fire extinguishing agent according to claim 1 to a burning material.

* * * * *